US005536070A

United States Patent [19]

Lemmen

[11] Patent Number: 5,536,070

[45] Date of Patent: Jul. 16, 1996

[54] ADJUSTABLE ERGONOMIC ARM REST

[76] Inventor: Roger D. Lemmen, 1241 Heather Dr., Holland, Mich. 49423

[21] Appl. No.: 132,657

[22] Filed: Oct. 6, 1993

[51] Int. Cl.[6] ..... A47C 7/54

[52] U.S. Cl. ..... 297/411.37; 297/411.36; 297/411.38; 297/463.1

[58] Field of Search ..... 297/115, 116, 297/118, 411.2, 411.26, 411.27, 411.3, 411.31, 411.32, 411.33, 411.35, 411.36, 411.37, 411.38, 463.1; 248/118, 407, 188.5

[56] References Cited

U.S. PATENT DOCUMENTS

| | | | |
|---|---|---|---|
| 4,159,148 | 6/1979 | Schulz | 297/411.37 X |
| 4,277,102 | 7/1981 | Aaras et al. | 297/411 |
| 4,702,520 | 10/1987 | Whisler et al. | 297/417 |
| 4,822,103 | 4/1989 | Stenvall | 297/411 |
| 4,884,846 | 12/1989 | Tobler | 297/411 |
| 4,887,866 | 12/1989 | Rusin | 297/421 |
| 4,938,534 | 7/1990 | Tornero | 297/411.33 |
| 5,009,467 | 4/1991 | McCoy | 297/411 |
| 5,135,190 | 8/1992 | Wilson | 248/118.1 |
| 5,143,422 | 9/1992 | Althofer et al. | 297/411 |
| 5,169,207 | 12/1992 | Rye | 297/411.33 |
| 5,215,282 | 6/1993 | Bonutti | 248/118 |
| 5,242,138 | 9/1993 | Kornberg | 297/411.36 X |
| 5,265,938 | 11/1993 | Melhuish et al. | 297/411.36 |
| 5,318,347 | 6/1994 | Tseng | 297/411.36 |
| 5,326,154 | 7/1994 | Williamson et al. | 297/411.36 |
| 5,368,365 | 11/1994 | Feldberg | 297/411.36 |
| 5,388,892 | 2/1995 | Tornero | 297/411.36 |
| 5,393,125 | 2/1995 | Watson et al. | 297/411.36 |

*Primary Examiner*—Milton Nelson, Jr.
*Attorney, Agent, or Firm*—Brooks & Kushman

[57] ABSTRACT

An ergonomic arm rest for a chair having a forward arm rest pad and a rear arm rest pad supported by a vertical support mechanism. The vertical support mechanism permits the vertical, horizontal and transverse adjustment of the location of the arm rest pads. The vertical support mechanism allows the position of the forward and rear arm rest pads to be reversed. The rear arm rest pad is attached to an extendable element which facilitates the displacement of the rear arm rest pad above and away from the forward arm rest pad. The forward arm rest pad is horizontally displaceable relative to the vertical support mechanism and may be angularly displaced.

30 Claims, 4 Drawing Sheets

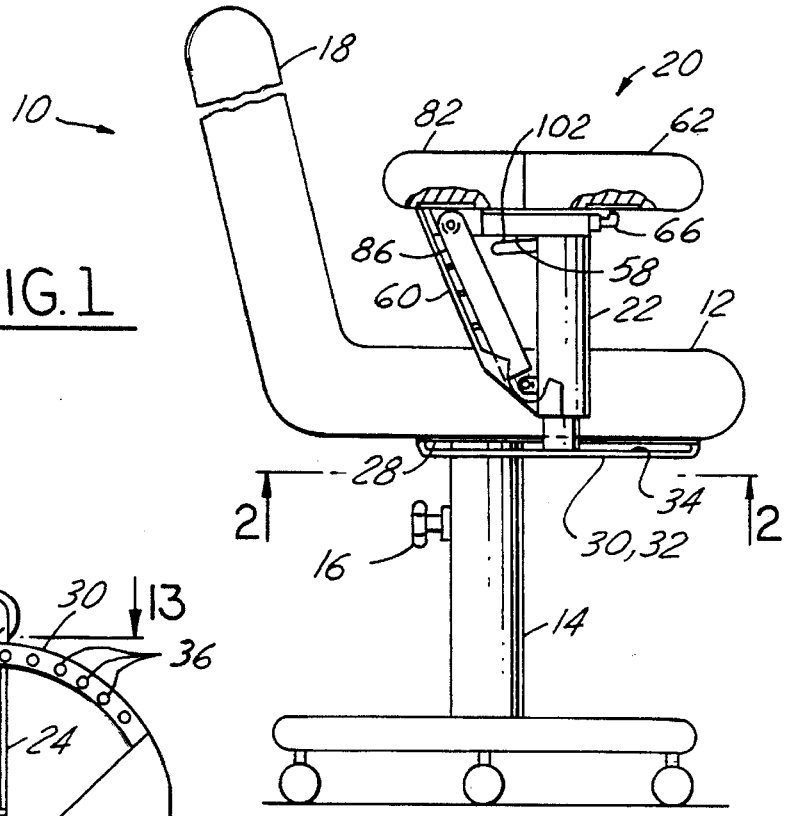
FIG. 1
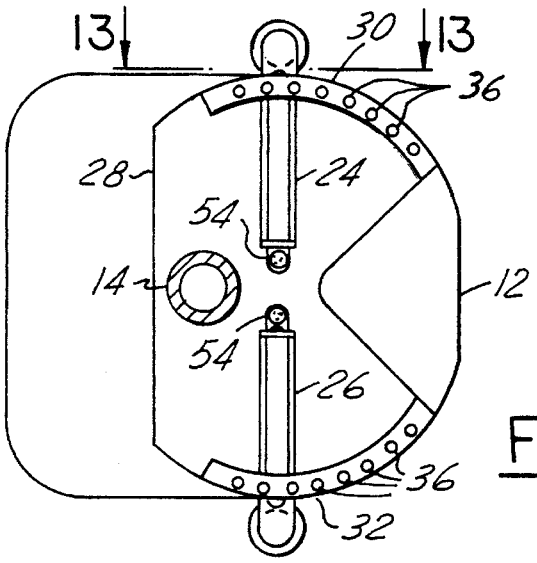
FIG. 2
FIG. 3
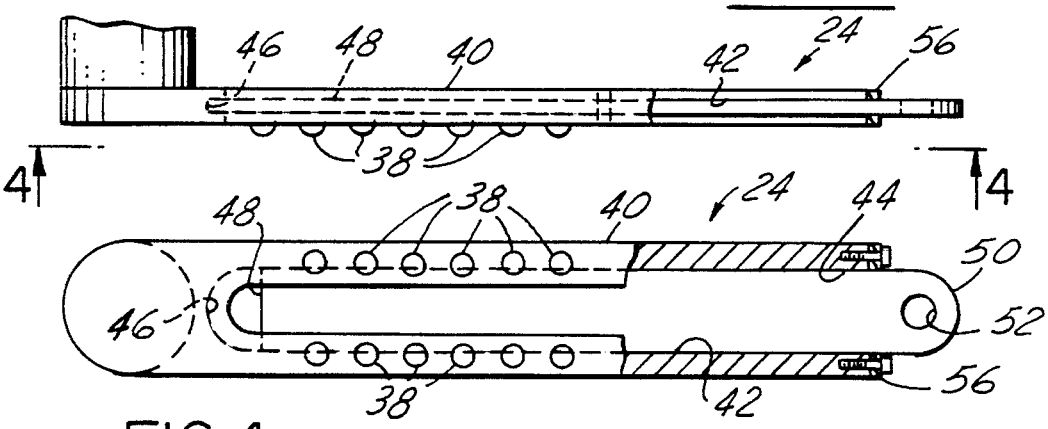
FIG. 4
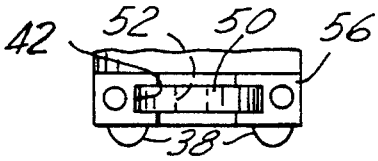
FIG. 5

ADJUSTABLE ERGONOMIC ARM REST

TECHNICAL FIELD

The invention is related to arm rests for a chair and, in particular, to an adjustable ergonomic arm rest for a chair to prevent cumulative trauma disorders.

BACKGROUND ART

Cumulative trauma disorders, caused by precipitated by or aggravated by repeated exertions or movement of the body, are prevalent in those persons who must perform repeated tasks for extended periods of time. The cumulative trauma disorders may be a muscular problem, such as myalgia, a tendon problem such as tendinitis or a nerve problem such as carpal tunnel syndrome.

The prior art has developed a number of chairs having movable seats, backs and arm rests. To reduce the conditions which may cause, precipitate or aggravate the cumulative trauma disorders.

Aaras et al, in U.S. Pat. No. 4,277,102, discloses a chair in which arm rests disposed on the opposite sides of the seat are adjustable in height, width and angle, by means of lockable universal joints. Stenvall, in U.S. Pat. No. 4,822,103, discloses an arm rest adjustable in a vertical and a horizontal direction while Tubler, in U.S. Pat. No. 4,884,846, discloses an arm rest for a chair adjustable in a vertical and transverse direction. Resin, in U.S. Pat. No. 4,887,866, discloses an adjustable arm rest connected between a seat and a reclinable back of a chair.

Wilson, in U.S. Pat. No. 5,135,190, discloses an articulating ergonomic support system for supporting separately the forearm and wrist of the occupant. The wrist support may be adjusted horizontally with respect to the forearm support and adjusted in a vertical direction by means of an eccentric. Althofer et al, in U.S. Pat. No. 5,143,422, discloses an adjustable active arm support which may be adjusted in the vertical and transverse directions and the arm rest itself may be rotated in a horizontal plane and tilted to fully support the occupants forearm. Finally, Bonutti, in U.S. Pat. No. 5,215,282, discloses an adjustable arm rest for a chair adjustable in a vertical direction, transverse direction, tiltable about a horizontal axis for optimum support of the forearm.

Although the prior art teaches arm rests which support the forearm and wrist of the chair's occupant, there are many known applications in which it is desirable to support both the upper arm as well as the forearm to reduce the occurrence of cumulative trauma disorders.

SUMMARY OF THE INVENTION

The invention is an adjustable ergonomic arm rest for a chair having at least a seat, a back, and an arm rest provided on each side of the seat. Each arm rest comprises a vertical support mechanism attached to the seat and a forward arm rest attached to the top of the vertical support mechanism. A first extendable element, displaceable between a retracted position and an extended position is pivotably attached to the vertical support mechanism at a location displaced from the forward arm rest. A rear arm rest is pivotably attached to the free end of the first extendable element. The rear rest pad being located adjacent to the forward arm rest pad when the extendable element is in the retracted position and is displaced above and to the rear of the forward arm rest pad when the extendable element is in the extended position. In the displaced position, the rear rest pad can support the upper arm of the chair's occupant when his or her forearm is resting on the forward arm rest.

In the preferred embodiment, the vertical support mechanism is vertically, horizontally and transversely adjustable relative to the seat of the chair. Also, the support mechanism is rotatively adjustable so as to switch the locations of the forward arm rest pad and the rear arm rest pad permitting the rear rest pad to function as a wrist support which may be elevated for reading, writing or holding a book. Also, the forward arm rest pad may be linearly and angularly displaced relative to the vertical support mechanism to provide the best ergonomic support.

One advantage of the arm rest is that it has two arm rest pads which may be displaced from each other providing a multiplicity of combinations of rest pad locations for ergonomically supporting the forearm, upper arm and wrists of the chair's occupant.

Another advantage is that the arm rests may be vertically, horizontally and transversely adjusted for the optimum ergonomic positions of the arm rest pads.

Still another advantage is that the positions of the forward and rear arm rest pads may be reversed, increasing the flexibility of the arm rest for a multiplicity of applications.

These and other advantages will become more apparent from a reading of the specification with reference to the drawings.

BRIEF DESCRIPTION OF THE DRAWINGS

FIG. 1 is a side view of a chair having ergonomic arm rests;

FIG. 2 is a bottom view of the chair taken along section line 2—2 of FIG. 1;

FIG. 3 is a side view of the slide 24;

FIG. 4 is a top view of the slide 24;

FIG. 5 is a front view of the slide 24;

DETAILED DESCRIPTION OF THE INVENTION

Figure 6:
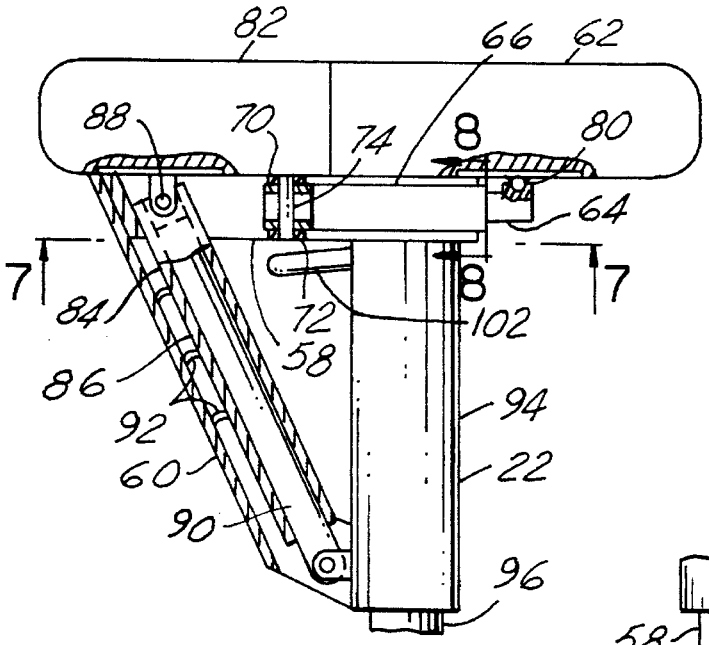
FIG. 6 is an enlarged portion of FIG. 1 showing the mounting details of the forward and rear arm rest pads.
Figure 8:
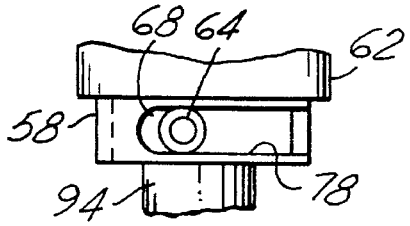
FIG. 8 is a partial front view.

A side view of a chair 10 having a pair of ergonomic arm rests is shown in FIG. 1. The chair 10 has a substantially horizontal seat 12 supported by a pedestal 14 above the floor. As is known in the art, the pedestal may include means, such as a height adjustment mechanism 16 to adjust the height of the seat above the floor for the comfort of the occupant. A back 18 is attached to the seat 12 and is disposed at a preselected angle thereto. As is known in the art, the angle at which the back 18 is disposed relative to the seat 12 may also be adjustable for the comfort of the occupant.

Ergonomic arm rests 20 (only one of which is shown) are disposed on opposite sides of the seat 12. Each ergonomic arm rest 20 has an adjustable vertical support member 22 which is pivotably attached, by means of extendable slides 24 and 26 to a mounting plate 28 attached to the bottom of the seat 12, as shown in FIG. 2. The mounting plate 28 has a pair of arcuate bridge members 30 and 32 provided adjacent to the outer periphery thereof which form arcuate slots such as arcuate slot 34, shown in FIG. 1. The arcuate slots 34 pivotably guide the pivotable motion of the extendable slides 24 and 26, respectively. The bridge members 30 and 32 may be separate elements fastened to the mounting plate 28 or may be a stamped depression adjacent to the periphery thereof. The arcuate bridge members 32 and 34 each have a plurality of nipple receptors, such as apertures 36 provided therethrough at predetermined locations which receive the nipples 38 provided on the bottom side of the extendable slides 24 and 26. Alternatively, the nipple receptors may be a plurality of detents provided in the bridge members 32 and 34.

The details of the extendable slides 24 are shown in FIGS. 3, 4 and 5. Because the structure of the extendable slides 24 and 26 are identical, only the structure of extendable slide 24 will be discussed in detail. FIG. 3 is a bottom view of the extendable slide 24. The extendable slide 24 has a rectangular U-shaped sleeve 40 attached to the adjustable vertical support mechanism 22. The sleeve 40 has a rectangular slot 42 provided therein having an open end 44 and a closed end 46. A slide bar 48 is slidably received in the rectangular slot 42. The slide bar 48 has a connector end 50 which has a mounting aperture 52 by means of which it is pivotally connected to the seat mounting plate 28 by a bolt or stud 54 as shown in FIG. 2.

An end piece 56 is attached to the ends of the U-shaped sleeve 40 inhibiting separation of the ends from each other. A plurality of knobs or nipples 38 are provided along the lower surface of each leg of the U-shaped sleeve 40. The nipples 38 are arranged in transverse pairs and the nipples 38 in each transverse pair are transversely separated from each other by a distance equal to the distance separating the nipple apertures 36 in the bridge members 30 and 32.

In use, the arm rest 20 may be lifted sufficiently to disengage the nipples 38 from the apertures 36. The arm rest 20 may then be pivoted clockwise or counterclockwise in the slots 30 to the desired location. The pivoting of the arm rest 20 in the slots 34 is equivalent to linearly displacing the arm rest 20 relative to the sides of the seat 12.

In the lifted position, the extendable slides 24 and 26 may then be extended or retracted to the desired locations. After the desired adjustment, the arm rest 20 is lowered and with slight horizontal and pivotable adjustment, a pair of nipples 38 will engage in the closest set of nipple apertures 36 in the bridge member. This permits the arm rest 20 to be moved in a back or forward direction as well as a transverse direction to the most advantageous ergonomic position for the occupant.

Figure 13:
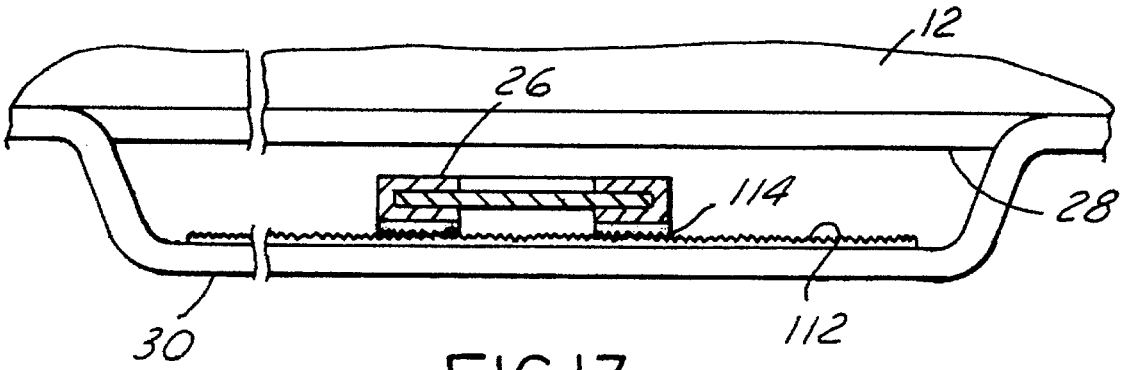
FIG. 13 is a partial side view showing an alternate embodiment of attaching the side to the mounting plate.

In an alternate embodiment, mating elements 112 and 114, respectively, of a hook and loop type fastener sold under the trade name VELCRO® type fastener may be attached to the upper surfaces of the bridge members 30 and 32 and the lower surface of the extendable slides 24 and 26 as shown in FIG. 13. The hook and loop replace the nipples 38 and nipple receptors 36, permitting infinite pivotable adjustment of extendable slides 24 and 26 in the slots 34 and infinite linear adjustment of the extendable slides 24 and 26 relative to the seat 12 of the chair.

The upper end of the vertical support mechanism 22 is fixedly attached to a forward end of a horizontally disposed bracket 58. A brace, such as brace 60, may be attached between the rear end of the bracket 58 and the vertical support mechanism 22. The arm rest 20 has a forward arm rest pad 62 pivotably attached to an extendable member 64 of a horizontally extendable element, such as horizontal telescopic cylinder 66 by a ball socket 80. The outer cylinder 68 of the horizontal telescopic cylinder 66 is pivotably attached to transverse members 70 and 72 of the bracket 58 by a pin 74, as shown more clearly in FIGS. 6 and 7. The pin 74 is received in a transverse slot 76 which permits the end of the outer cylinder 68 to be displaced in a transverse direction.

The extendable member 64 of the horizontal telescopic cylinder 66 extends external to the bracket 58 through a horizontal slot 78 provided in the forward end of the bracket 58.

The slots 76 and 78 permit limited horizontal angular displacement of the forward pad 62 relative to the horizontal bracket 58. The telescopic cylinder 66 permits linear extension of the forward pad 62, while the ball joint 80 permits tilting 360° rotation of the forward pad 62 relative to the end of the horizontal telescopic cylinder 66.

A rear pad 82 is pivotably attached to the sleeve 84 of an extendable element such as rear telescopic cylinder 86 by means of a pivot pin 88. The rear telescopic cylinder 86 has a piston 90 pivotably attached to the vertical support mechanism 22 at a predetermined location displaced below the bracket 58. The upper end of the rear telescopic cylinder 86 is captivated within the rearward portion of the bracket 58 which limits its angular displacement relative to the vertical support mechanism 22. As shown more clearly in FIG. 7, the rearward end of the horizontal bracket 58 has a V-shaped contour which aligns the position of the rear telescopic cylinder 86 relative to the vertical support member 22.

Figure 11:
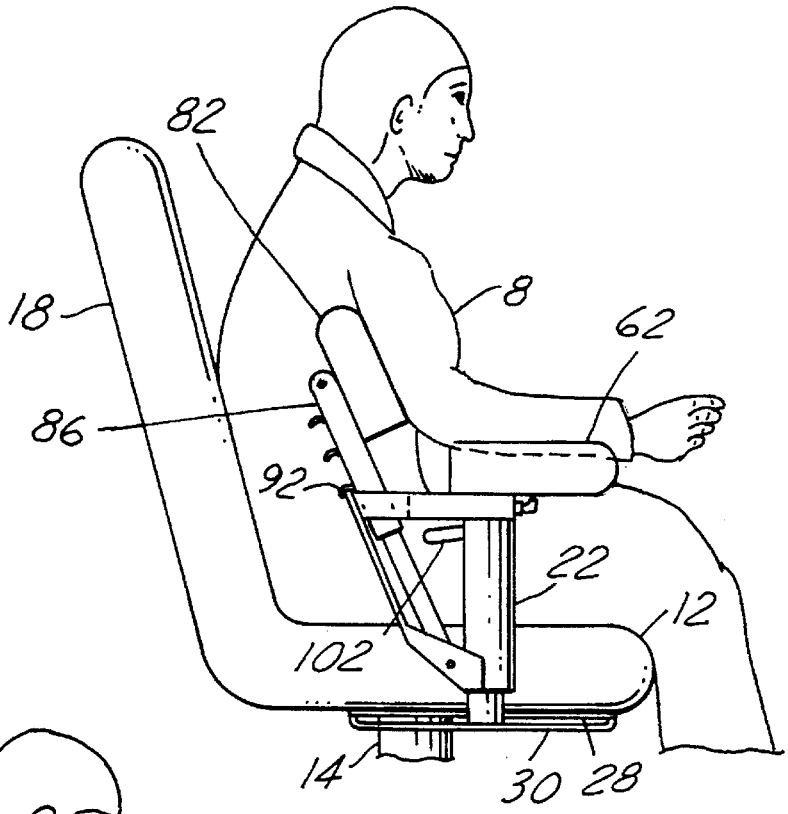
FIG. 11 is a partial side view of the chair with the first extendable member in its extended position.

The rear telescopic cylinder 86 has a plurality of fasteners such as hooks 92 projecting from the external surface of the sleeve 84 in a direction away from the vertical support mechanism 22. The hooks 92 are longitudinally disposed along the length of the sleeve 84 at predetermined intervals and are adapted to engage the upper edge of the bracket 58, as shown in FIG. 11, to adjust the position of the rear rest pad 82 relative to the bracket 58. In this manner, the position of the rear rest pad 82 may be adjusted to support the upper arm of the chair's occupant relieving the corresponding forces from being exerted on the occupant's elbow or shoulder. As shown in FIG. 11, the occupant's elbow may be located intermediate the forward arm rest pad 62 and the rear rest pad 82.

Figure 14:
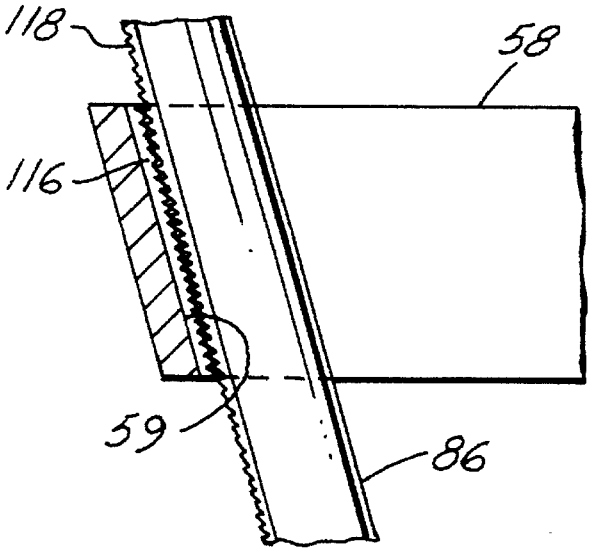
FIG. 14 is a partial cross-sectional view showing an alternate embodiment of attaching the extendable arm to the horizontal bracket.

Alternately, the hooks 92 may be replaced by a first element 116 of a hook and loop type fastener sold under the trade name VELCRO® and a second element 118 of the hook and loop type fastener may be attached to the adjacent inner surface 59 of the bracket 58, as shown in FIG. 14.

Figure 7:
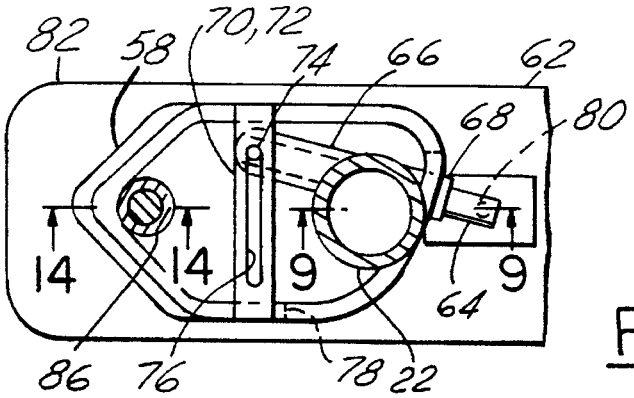
FIG. 7 is a bottom view taken along section line 7—7 of FIG. 6.
Figure 9:
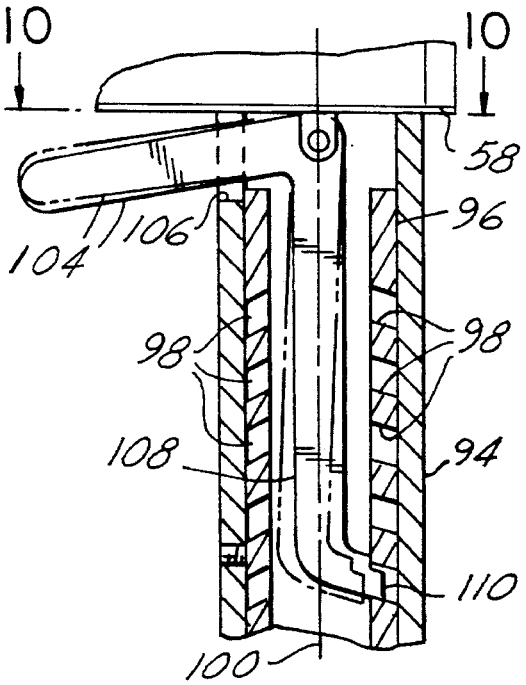
FIG. 9 is a side cross-sectional view of the vertical support mechanism.
Figure 10:
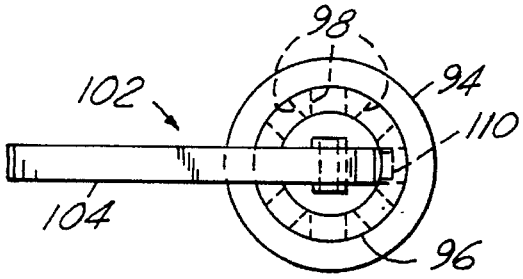
FIG. 10 is a cross-sectional view taken along section line 10—10 of FIG. 9.

The details of the vertical support mechanism 22 are shown in FIGS. 1, 9 and 10. As shown in FIG. 6, each vertical support mechanism 22 has an outer sleeve 94 fixedly attached to one end of the associated support 58 and an inner sleeve 96 telescopically received in outer sleeve 94. Each inner sleeve 96 is fixedly attached to a selective one of the horizontal slides 24 and 26. The inner sleeve 96, as shown in FIGS. 9 and 10, have a plurality of catch bores 98 provided therethrough. The catch bores 98 are arranged in horizontally aligned sets along a portion of the length of the inner sleeve 96. Each horizontally aligned set of catch bores 98 have a predetermined number or catch bores 98 angularly disposed relative to each other.

In the embodiment shown in FIG. 10, each horizontally aligned set has eight catch bores 98 disposed at 45° angular increments. However, the number of catch bores in each set is not limited to the number shown in FIGS. 10, but may consist of any number of catch bores 98 ranging from a single catch bore to more than the 8 shown.

Preferably, the catch bores 98 are disposed at an angle relative to the longitudinal axis 100 of the inner sleeve 96. However, the catch bores 98 may be normal to the axis 100 or at any other selected angle.

A lever 102 is pivotably mounted within the inner sleeve 96. The lever 102 has a handle portion 104 extends external to the outer sleeve 94 through a vertical slot 106 provided therethrough, a substantially vertical portion 108, and a dog catch 110 extending from an end of the vertical portion 108 opposite the handle portion 104. The weight of the handle portion 102 produces a torque in a direction causing said dog catch 110 to be held in a selected one of the catch bores 98, as shown in FIG. 9. A coil spring (not shown) connected between the lever 102 and the bracket 58 or the outer sleeve 94 may be used to augment the torque produced by the weight of the handle portion 104 holding the dog catch 110 in the catch bore 98.

In operation, the handle portion 104 of the lever 102 is raised by the occupant to disengage the dog catch 110 from the catch bore 98 in which it was engaged. This permits the outer sleeve 94 to be vertically raised or lowered relative to the inner sleeve 96. It also permits the outer sleeve 94 to be rotated 360° about the vertical axis 100 relative to the inner sleeve 96.

In some practical applications, it is not necessary for the outer sleeve 94 to be rotated away from the seat 12, therefore the rotation of the outer sleeve 94 relative to the inner sleeve may be limited by the angle subtended between the first and last catch bore in each set.

In the preferred arrangement, the angle subtended between the first and last catch core is 180° which permits a 180° angular rotation of the outer sleeve 94 relative to the inner sleeve 96.

FIG. 11 shows the chair with the rear telescopic cylinder 86 in an extended position, in which the rear rest pad 82 is elevated above and to the rear of the forward arm rest pad 62. The rear rest pad 82 can now be engaged by the upper arm of the occupant 8. Because the rear arm rest pad is pivotably attached to the rear telescopic cylinder 86, it will pivot to comfortably engage the occupant's upper arm as shown. The forearm of the occupant may now rest comfortably on the forward pad 62. Instead of resting the forearm on the forward pad 62, the horizontal telescopic cylinder 66 may be extended so that the occupant's wrists may be supported by the forward arm rest pad 62 if so desired. Also, the forward arm rest pad 62 may be rotated inwardly to place the forward pad inwardly thereby decreasing the distance between the forward arm rest pads 62 on opposite sides of the seat. This permits the occupant's arms to be brought closer together to their optimum ergonomic location and to allow supported movement of the forearms through a defined range of activity.

Figure 12:
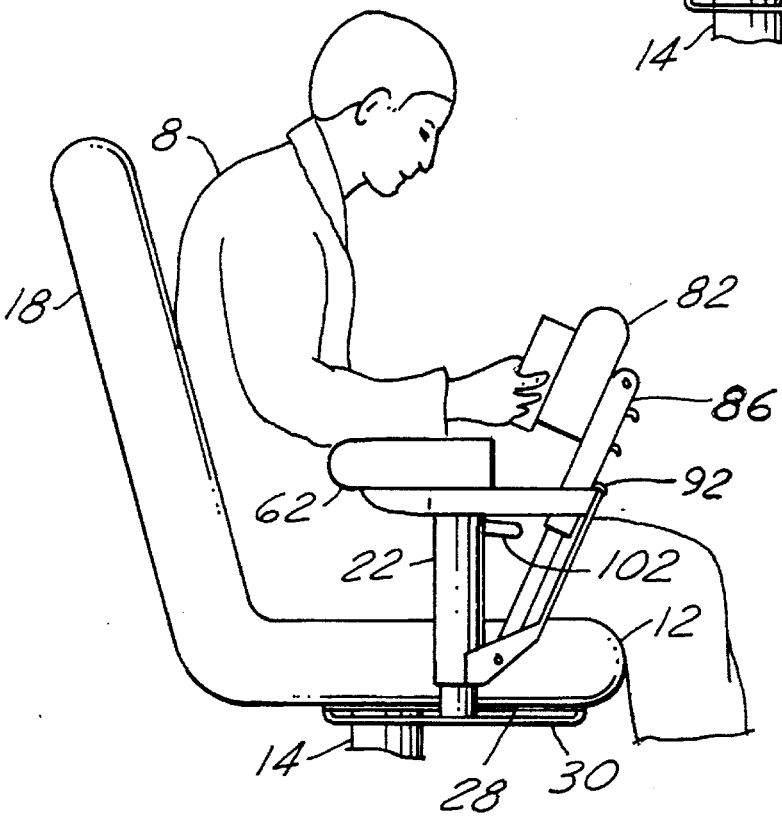
FIG. 12 is a partial side view of the chair with the vertical support member rotated 180° and the first extendable member in an extended position.

In FIG. 12, the outer sleeve 94 is rotatable 180° from the position shown in FIGS. 1 and 11 so that the rear rest pad 82 is now forward of the forward arm rest pad 62. In this orientation, the rear arm rest pad 82 may be elevated above the forward arm rest pad 62 supporting the occupant's wrists or forearm in an elevated position, as shown, for the purpose of writing, reading a book, or any other activity in which the forearm or wrists of the occupant are elevated. The separation of rear pads 62 may be adjusted by extending or retracting the slides 24 and 26 or changing the position of the telescopic slides 24 and 26 within the slots 34. It is also possible to change the location of rear pads by rotating the outer cylinder 94 of the support mechanism 22 relative to the inner cylinder 96.

As may be determined from the above description, the ergomatic arm rest described herein permits the forward and rear arm rest pads to be placed in a wide variety of positions to prevent undue stress on the wrists, forearms, upper arms and shoulders of the occupant, thereby reducing the occurrence of a cumulative trauma disorder precipitated or aggravated by repeated exertions or movement of the body.

It is not intended that the invention be limited to the specific chair shown in the drawings or the specific embodiment of the ergomatic arm rests shown in the drawings and discussed in the specification. It is known that those skilled in the art may make certain changes or improvements to the disclosed embodiment within the scope of the invention set forth in the appended claims.

What is claimed:

1. Arm rests for a chair having at least a seat, a back, and an arm rest provided on each side of said seat, each of said arm rests comprising:

a vertical support mechanism having a bottom adapted to be attached to the seat and a top;

a forward arm rest pad attached to said top of said support mechanism;

a rear extendable element having an upper end and a lower end, said lower end pivotably attached to said vertical support mechanism at a location displaced below said top, said upper end of said rear extendable element displaceable between a retracted position to an extended position; and a rear arm rest pad pivotably attached to said upper end of said rear extendable element, said rear rest pad being adjacent to said forward arm rest pad when said rear extendable element is in said retracted position and is displaced above said forward arm rest pad when said rear extendable element is in said extended position.

2. The arm rests of claim 1 wherein said rear extendable element is disposed at an angle to said vertical support mechanism, such that said rear arm rest pad is disposed above and to the rear of said forward arm rest pad when said rear extendable element is in said extended position.

3. The arm rests of claim 2 having means for securing said rear extendable element in at least said extended position and at least one position intermediate said retracted and extended positions.

4. The arm rests of claim 3 wherein said vertical support mechanism has a horizontal bracket attached to said top, and wherein said forward arm rest pad is attached to said horizontal bracket and said rear rest pad rests on said horizontal bracket when said rear extendable element is in said retracted position.

5. The arm rests of claim 4 wherein said bracket has an opening provided therethrough, and wherein said upper end of said rear extendable element is captivated in said opening.

6. The arm rests of claim 5 wherein said means for securing is at least two hooks provided along the length of said rear extendable element, said at least two hooks engageable with an edge of said bracket to secure said rear extendable element in said extended and intermediate positions respectively.

7. The arm rests of claim 4 further comprising a horizontal extendable element displaceable between a retracted position and an extended position, said horizontal extendable element having one end attached to said horizontal bracket and an opposite end attached to said forward arm rest pad, said horizontal extendable element permitting said forward arm rest pad to be horizontally displaced relative to said horizontal bracket.

8. The arm rests of claim 7 wherein said horizontal bracket has a horizontal slot receiving said horizontal extendable element therethrough, and wherein said one end of said horizontal extendable element is pivotably attached to said horizontal bracket permitting said horizontal extendable element to be horizontally pivoted within said horizontal slot.

9. The arm rests of claim 8 wherein said forward arm rest pad is attached to said opposite end of said horizontal element, by a ball joint permitting said forward arm rest pad to be tilted and horizontally rotated relative to said horizontal bracket.

10. The arm rests of claim 8 wherein said one end of said horizontal extendable element is pivotably and slidably attached to said horizontal bracket.

11. The arm rests of claim 1 wherein said vertical support mechanism comprises:

a mounting plate adapted to be attached to a bottom surface of the seat;

a slide having a first end pivotably attached to said mounting plate and pivotable in a plane parallel to said mounting plate, said slide further having a free end adapted for extending beyond a side of the seat;

a first cylinder vertically attached to said free end of said slide;

a second cylinder telescopically displaceable with said first cylinder;

a horizontal bracket attached to a top of said second cylinder; and a first locking mechanism having a locked state inhibiting the rotation and axial displacement of said second cylinder relative to said first cylinder and an unlocked state permitting a rotation and axial displacement of said second cylinder relative to said first cylinder.

12. The arm rests of claim 11 wherein said mounting plate has at least one arcuate bridge for forming an arcuate slot adjacent to said side of the seat, and wherein said free end of said slide is slidably received through said slot.

13. The arm rests of claim 11 wherein said second cylinder can be rotated 180° relative to said first cylinder reversing the position of said horizontal bracket and said forward arm rest pad relative to said rear rest pad, permitting said rear rest pad to be positioned above and forward of said forward rest pad when said rear extendable element is displaced from said retracted position.

14. The arm rests of claim 11 wherein said at least one arcuate bridge is a pair of arcuate bridges for forming arcuate slots on opposite sides of the seat, and wherein said slide is a pair of slides, with one of said pair of slides adapted to be associated with a respective one of said arm rests on each side of the seat, each of said pair of slides is slidably received through a respective one of said arcuate slots.

15. The arm rests of claim 14 wherein each of said pair of slides is adapted to be linearly displaceable between a retracted position adjacent to said side of the seat and an extended position displaced from said side of the seat.

16. The arm rests of claim 15 including means for locking each of said pair of slides at predetermined locations within said slots and for prohibiting a linear displacement of said slide between said retracted position and said extended position.

17. The arm rests of claim 16 wherein said means for locking comprises:

a first element of a hook and loop type fastener attached to a surface of each arcuate bridge of said pair of arcuate bridges; and a second element of said hook and loop type fastener attached to a lower surface of said slide, said second element engageable with said first element of said hook and loop type fastener to lock said slide to said bridge inhibiting said pivotable and said linear displacement of said slides relative to said mounting plate.

18. The arm rests of claim 16 wherein said means for locking comprises:

a set of equally spaced nipple receptors provided along each arcuate bridge of said pair of arcuate bridges along an arcuate path, and a first plurality of nipples provided on a lower surface of each of said slides, said first plurality of nipples forming a second plurality of transverse pairs of nipples receivable in adjacent nipple receptors, said transverse pairs of nipples being longitudinally disposed along the length of said slide, the engagement of a selected transverse pair of nipples in selected nipple receptors inhibiting a pivotable displacement and said linear displacement of said slide relative to the mounting plate.

19. The arm rests of claim 18 wherein said nipple receptors are nipple apertures.

20. The arm rests of claim 18 wherein said arcuate slots have a height sufficient to disengage said nipples from said nipple receptors when said slides are displaced in a vertical direction.

21. A support mechanism for arm rests for a chair, said chair having at least a seat, said support mechanism comprising:

a base plate attachable to a bottom surface of the seat;

a pair of arcuate bridges adapted to extend from said base plate in a downward direction away from the seat, said pair of arcuate bridges adapted to be disposed on opposite sides of said base plate and forming a pair of arcuate slots adjacent to opposite sides of the seat, said arcuate slots lying in a plane substantially parallel to said base plate;

a pair of slides, each slide of said pair of slides extending through a respective one of said pair of slots and each slide of said pair of slides has one end pivotably attached to said base plate, each slide of said pair of slides having a free end for extending beyond the side of the seat, said free end of each slide of said pair of slides being displaceable between a retracted position adjacent to a side of the seat and an extended position;

a pair of vertical members, each vertical member of said pair of vertical members being attached to said free end of a respective one of said pair of slides;

an arm rest attached to each vertical member of said pair of vertical members; and means for locking said pair of slides in said pair of arcuate slots to prohibit an angular displacement of said pair of slides within said pair of slots and a linear displacement of said free end of each of said pair of slides, said means responsive to a vertical displacement of said pair of slides within said pair of slots to enable said slides to be angularly displaced within said arcuate slots and said free ends of said pair of slides to be linearly displaced.

22. The support mechanism of claim 21 wherein said means for locking comprises:

a first element of a hook and loop type fastener attached to an upper surface of each arcuate bridge of said pair of arcuate bridges; and a second element of a hook and loop type fastener attached to a lower surface of each slide of said pair of slides, said second element engageable with said first element to pivotably and linearly lock said slides to said arcuate bridges.

23. The support mechanism of claim 21 wherein said means for locking comprises:

a plurality of equally spaced nipple receptors provided through each of said arcuate bridges along an arcuate path; and a first plurality of nipples provided on a surface of each of said slides adjacent to said arcuate bridge, said first plurality of nipples provided on the surface of each slide being divided into a second plurality of transverse nipple pairs, said nipples in said transverse nipple pairs being spaced from each other a distance equal to the distance of said equally spaced nipple receptors, said transverse nipple pairs being linearly spaced along the length of each slide of said pair of slides, said transverse nipple pair engageable respectively in adjacent nipple receptors in each of said arcuate bridges to lock each slide of said pair of slides prohibiting both an angular displacement of said slides relative to said base plate and a linear displacement of said free ends relative to said base plate.

24. The support mechanism of claim 23 wherein said plurality of nipple receptors are a plurality of nipple apertures.

25. The support mechanism of claim 23 wherein each slide of said pair of slides comprises:

a rectangular sleeve having a rectangular slot provided therein, said rectangular slot having a closed end and an open end;

a slide bar slidably received in said rectangular slot through said open end, said slide by having a free end adapted to be pivotably attached to said base plate; and wherein said plurality of nipples are provided on said lower surface of said rectangular sleeve.

26. A vertically displaceable support mechanism for arm rests of a chair having at least a seat, said vertically displaceable support mechanism comprising:

a first vertically oriented cylinder having one end adapted to be attached to the seat, said first cylinder having a plurality of catch bores provided therethrough, said plurality of catch bores being divided into sets of catch bores equally spaced from each other about a horizontal plane, each set of catch bores comprises a selected number of catch bores disposed at equally spaced intervals along the length of said first cylinder;

a second vertically oriented cylinder telescopically received over said first cylinder; and a locking lever having an external handle portion and a vertical portion, said vertical portion pivotably disposed internal to said second cylinder, said locking lever displaceable from a locked position to a released position, said vertical portion having a catch engaging a selected one of said catch bores when said locking lever is in said locked position, said catch being disengaged from said catch bores when said locking lever is in said released position.

27. The vertically displaceable support mechanism of claim 26 wherein said catch bores in said sets of catch bores are equally spaced 360° around said first cylinder.

28. The vertically displaceable support mechanism of claim 26 wherein said catch bores in said sets of catch bores are equally spaced 180° around said first cylinder.

29. The vertically displaceable support mechanism of claim 26 wherein each set of said sets of catch bores comprises a single catch bore.

30. A chair comprising:

a seat;

a back attached to said seat;

means for supporting said seat relative to a floor;

a vertical support mechanism having a top and a bottom attached to said seat;

a forward arm rest pad attached to said top of said vertical support mechanism;

a rear extendable element having an upper end and a lower end, said lower end attached to said vertical support mechanism at a location displaced below said top, said upper end of said extendable element being displaceable between a retracted position and an extended position; and a rear arm rest pad pivotably attached to said upper end of said rear extendable element, said rear arm rest pad being positioned adjacent to said forward arm rest pad when said rear extendable element is in said retracted position and is displaced above and to the rear of said forward arm rest pad when said rear extendable element is in said extended position.

* * * * *